United States Patent [19]

Wagner

[11] Patent Number: 4,763,552

[45] Date of Patent: Aug. 16, 1988

[54] PUNCH PIN CONFIGURATION

[75] Inventor: Willard E. Wagner, Arlington Heights, Ill.

[73] Assignee: Acco World Corporation, Wheeling, Ill.

[21] Appl. No.: 40,230

[22] Filed: Apr. 20, 1987

[51] Int. Cl.[4] ..... B26F 1/14

[52] U.S. Cl. ..... 83/689; 83/684; 83/697; 76/101 R

[58] Field of Search ..... 83/697, 689, 684, 686; 76/101 R

[56] References Cited

U.S. PATENT DOCUMENTS 4,257,300 3/1981 Muzik ..... 83/689 X

FOREIGN PATENT DOCUMENTS 2631117 1/1978 Fed. Rep. of Germany ..... 83/689

1544694 4/1979 United Kingdom ..... 83/689

*Primary Examiner*—Donald R. Schran

*Attorney, Agent, or Firm*—Pennie & Edmonds

[57] ABSTRACT

A punch pin cutting edge configuration having a leading edge and a following edge is described. The leading edge engages a workpiece, such as paper, before the following edge. The following edge is at a steeper angle than the leading edge relative to the workpiece being punched. The cutting edge thus produced reduces the force necessary to punch through the workpiece.

3 Claims, 1 Drawing Sheet

PUNCH PIN CONFIGURATION

FIELD OF THE INVENTION

The present invention relates to elements for punching holes in thin material. More specifically, the present invention relates to pins for punching holes in paper.

BACKGROUND OF THE INVENTION

Various methods have been used to arrange papers together for storage and reading. Loose sheets of paper can be permanently bound by gluing, sewing, stapling, and the like. Papers can also be held together with readily removable fasteners and releasable binders, for example. Such fasteners commonly have an enlarged head with a stem that is inserted through a punched hole with the stem end then bent radially outward at the back of that hole. In addition, binders, such as two-ring and three-ring binders, have spring biased rings which hold loose sheets of paper together. Such releasable binders and removable fasteners permit the easy binding of loose sheets of paper, yet permit the ready removal of the papers for copying, for instance.

Among the more important requirements in making a hole for paper binding purposes is that the hole be uniform, neat and properly aligned with other holes in papers to be bound. That is, the holes should look the same after every punch, with the holes made so that their edges are precise, and not jagged.

Ordinarily a hole will be made through many sheets of paper at one time. As many as twenty to thirty sheets may be simultaneously placed in a manually-driven punching device, for example, such as a three-hole punch operated by hand force.

Various punch pin configurations have been used to make sharp and uniform holes. These pins are typically cylindrical in shape, with a base having a circular cross section. The variations in the pins are generally found in the shape of the punch pin base.

Originally, such punch pins had a flat circular cutting edge. However, it became apparent that these pins required large amounts of force to perforate the paper due to the large surface area of the paper being engaged at one time by the cutting surface of the pin. In addition, because the entire surface area of the base cut the paper all at once, higher shear forces were applied to the edges of the hole being created. This caused the paper to be "pulled" around the edges into the hole, resulting in a dull hole edge.

Another punch pin cutting edge configuration is shown in U.S. Pat. No. 3,714,857. The punch pin is cylindrical with a generally circular cross section. The cutting edge of the punch pin has a parabolic-shape when viewed in section.

The punch pin pierces the paper along a smaller cross section of the edge at the base of the cylinder. The paper furthermore contacts a variably changing cutting edge, so that the entire edge of the base never comes into contact with the paper at once. This reduces the force necessary to cut the paper because of the reduced surface contact between the pin and the paper. Conversely, using the same amount of force to pierce the paper results in a greater pressure on the paper being cut because of the lower surface contact. This allows the user to cut more sheets of paper with the same force. This higher pressure over a smaller area also results in a sharper cut, because the "pull" on the edge of the hole is reduced.

Other punch pin configurations have also focused upon a reduction in the force necessary to make the paper hole. Such configurations have included highly sloped piercing points as well as rippled or star-shaped patterns on the cutting edge. There is thus a desire in the industry to develop a cutting edge configuration for a punch pin which creates a sharp, clean cut with the least amount of force possible.

SUMMARY OF THE INVENTION

The present invention comprises an improved punch pin with a cutting edge configuration that yields the desired clean cut with reduced force. The punch pin of the invention has a stem with a generally circular cross section (i.e., across the pin diameter) at least at one end. This one end, or base, has a generally concave or bowl-shaped configuration defining a cutting edge with two initial points of cutting entry along the edge, such as on opposite sides of the cutting edge. A leading edge and a following edge follow respective smooth curves between these entry points.

The leading edge of the punch pin has a fairly shallow curve, while the following edge has a steeper slope when viewed with respect to a plane perpendicular to the longitudinal axis of the stem, i.e. the plane of a piece of paper being punched. The curves of both the leading and following edges are preferably smooth inward curves reaching respective center points on opposite sides of the stem. The points of entry, which are the furthest extensions of the cutting edge, and the center of the leading and following edges are thus spaced about 90° apart in alternating fashion.

The center of the leading edge is at a point slightly "higher" along the cutting edge than the center of the following edge, as measured along the longitudinal axis of the pin cylinder. This allows the leading edge to be the first of the two edges to come into contact with the paper (or other workpiece being punched).

When the cutting edge of the punch pin contacts the paper, it initially pierces at the two points of entry. More of the surface area on the leading edge than on the following edge then engages the paper. The greater part of the cutting force is thus initially concentrated on the leading edge. The following edge is more inclined, enhancing the cutting action of the following edge. What results is an overall reduction in the force necessary to punch a hole in the paper. With this reduction in force, more paper can now be pierced with the same force previously applied, or less force can be applied to punch the same amount of paper as similar prior art punch pins.

Additionally, the method for making this punch pin comprises a unique solution to creating a sharp cutting edge having a leading edge, a following edge and a hollow bowl-shaped end configuration. Essentially, the element used to cut the generally cylindrical punch pin comprises a disk-shaped cutting or grinding wheel. The cutting surface of the wheel is rounded, i.e. roughly semi-circular in radial cross section along the wheel edge. This wheel rotates about an axis of rotation at the center of the wheel, which allows one viewing the spinning cutting element to imagine a rotating torus in place of the cutting wheel.

The key aspect of making the cut is that the punch pin is positioned so that the longitudinal axis of its cylinder is angled relative to a diameter of the cutting wheel.

Putting it another way, and with regard to the imaginary torus, the longitudinal axis of the pin cylinder is parallel to a major radius of the torus. This angulation or skew between the longitudinal axis of the pin and the wheel/torus results in the formation of the foregoing leading and following edges of the present invention. Because a toroidal-like cutting wheel is used, the punch pin edge also becomes sharper than similar pieces made using reciprocating elements. Such a sharper cutting edge also reduces the surface area coming into contact with the paper, and consequently reduces the necessary force for cutting.

The cutting edge of the punch pin of the present invention thus makes a clean, uniform cut. The punch pin also cuts the paper so that pressure is applied to the paper substantially only along the cutting edge, and not the paper "within" the hole. Most significantly, the improved punch pin configuration reduces the force necessary to make a cut by an estimated 25%.

The invention, together with its attendant advantages, will be further understood by reference to the following detailed description taken in conjunction with the accompanying drawings, in which:

DETAILED DESCRIPTION OF A PREFERRED EMBODIMENT

Figure 1:
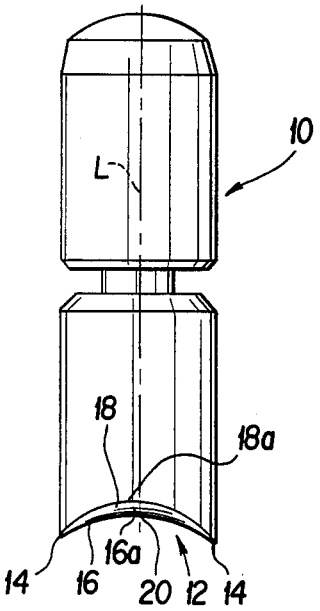
FIG. 1 is an elevational view of a preferred embodiment of the punch pin of the present invention showing the hollow, bowl-shape of the cutting end (the following edge being toward the viewer)
Figure 2:
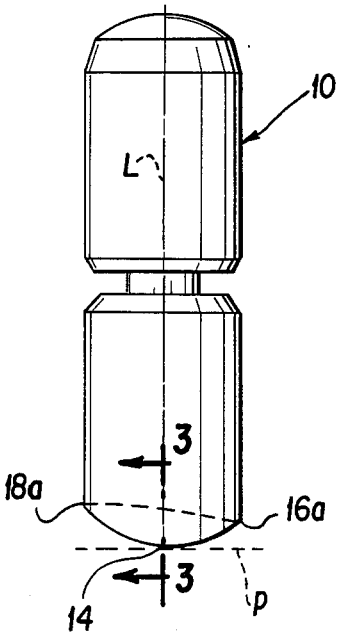
FIG. 2 is an elevational view of the punch pin of FIG. 1 rotated axially by 90°.
Figure 3:
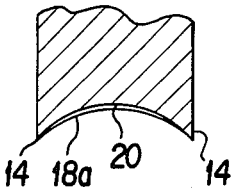
FIG. 3 is a partial cross sectional view taken across line 3—3 of FIG. 2.

As seen in FIGS. 1, 2 and 3, the present invention is a punch pin 10 which is generally cylindrical in shape with a circular cross section (taken across its radius). A cutting edge 12 is formed at one end (the base), comprising two points of initial entry 14, a leading edge 16, and a following edge 18. This cutting edge 12 surrounds a bowl-shaped (concave) underside or end 20.

Figure 6:
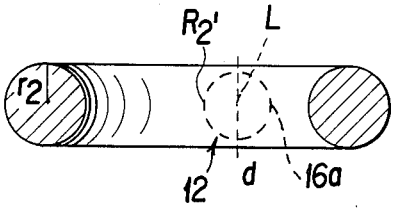
FIG. 6 is a cross section of the imaginary torus of FIG. 5 taken along lines 6—6.

The punch pin 10 is formed to make a circular cut in the paper for a circular hole. The points of entry 14 are diametrically opposed on the cutting edge 12 of the punch pin 10, which is circular in plan view (FIG. 6). The points of entry form the furthest points of the pin end 20 (and thus of the cutting edge 12), measured relative to the longitudinal axis L of the pin cylinder.

The leading edge 16 extends between the entry points 14 in a smooth curve. The curve is fairly shallow, as measured from a plane P which is perpendicular to the axis L, with the points 14 being coplanar with plane P. Plane P can be generally equated with the plane of a piece of paper to be punched by the pin 10. The curve of the leading edge 16 reaches a midpoint or center at 16*a*. The following edge 18 also extends between the entry points 14 on a smooth curve, but has a steeper slope than the leading edge 16 as measured from plane P. The curve of the following edge 18 reaches a midpoint or center at 18*a*. Center points 16*a* and 18*a* are roughly 180° apart.

As seen in FIG. 3, the leading edge 16 and the following edge 18 yield a generally semi-circular cross section (along the axis L) to the underside 20. The bowl-shaped underside 20 in the punch pin 10 allows paper to collect therein as the cutting edge 12 of the punch pin 10 is piercing through the paper.

As seen in FIG. 2, more of the leading edge 16 is brought to bear against the paper than the following edge 18 during the initial cutting. The cutting force is thus concentrated on the leading edge 16. The steeper slope of the following edge also reduces cutting effort, much as it is easier to cut with a knife that is more angled relative to the object being cut. The result of this configuration is an approximately 25% reduction in the force required to punch a given sheet of paper from that of contemporary punch pins with a conventional unangled bowl-shaped cutting end.

Figure 4:
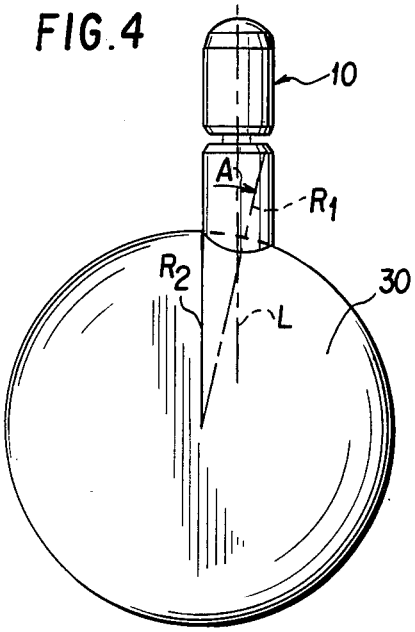
FIG. 4 is a partially schematic elevational view of the method of making a punch pin of the present invention by use of a disk-shaped cutting wheel.
Figure 5:
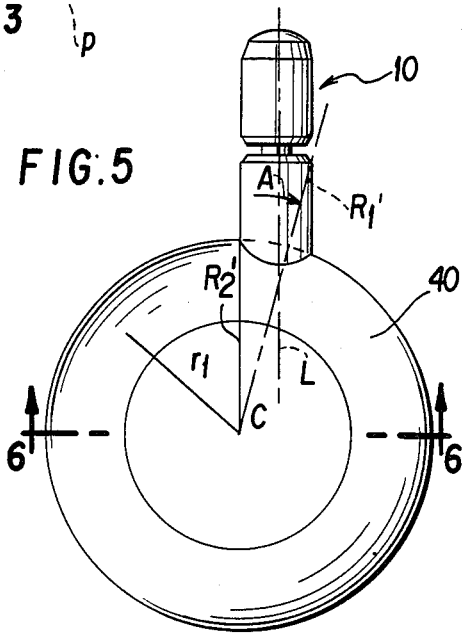
FIG. 5 is a schematic representation of an imaginary torus in place of the cutting wheel of FIG. 4.

The cutting edge 12 of punch pin 10 is formed using a cutting or grinding wheel 30 (FIG. 4), having a semi-circular radial cross section to its surface. The cutting wheel 30 can be compared to an imaginary torus 40, as shown in FIG. 5. The torus 40 has a major radius $r_1$ extending from an axis of rotation C. Torus 40 has a minor radius $r_2$, as best seen in FIG. 6.

The skew in the cutting edge 12 is created by angling the pin 10 relative to the wheel 30. That is, the cylindrical pin blank used to make pin 10 is angled for cutting relative to a radial line $R_1$ on the wheel. For example, if the punch pin 10 were to be cut with longitudinal axis L colinear with a wheel radius $R_2$, there would be no skew in the arc made in the pin end. However, by positioning the punch pin 10 such that its longitudinal axis L is angled relative to radial line $R_1$ (or parallel to radial line $R_2$), the resulting cut is made along an angle in the punch pin base. The leading edge 16 and following edge 18 are thus formed between the two points of entry 14.

With reference to FIG. 5, the torus 40 is merely meant as a geometric representation of the wheel 30. The radial lines $R_1'$ and $R_2'$ correspond to the radial lines $R_1$ and $R_2$ of the wheel 30, respectively. It will be noticed that the diameter of the torus, like that of wheel 30, is greater than the diameter of the pin base. The punch pin 10 would otherwise be ground with a cutting edge 12 containing an overhang. For the same reason, the diameter of the toric section, equivalent to twice the minor radius $r_2$, must be larger than the diameter of the pin base.

In addition, increasing the angle A between the radial line $R_1$ and longitudinal axis L will result in a steeper following edge 18 and a shallower leading edge 16. It has been found that the skew resulting in a maximum efficient punch pin cutting edge 12 is about an angle A of 6.7 degrees, where longitudinal axis L and radial line $R_1'$ intersect along a line d extending between entry points 14 (FIG. 6), and wheel 30 has a radius of about 1.25 inches, a crown having a radius (e.g., $r_2$) of 0.201 inches, and the pin cylinder has a radius of about 0.140 inches.

While the invention has been described in connection with a presently preferred embodiment, it will be apparent to those skilled in the art that various changes and modifications to the structure, arrangement, portions, elements, materials, and components used in the practice of the invention are possible without departing from the principles of this invention. It is intended that the foregoing description be regarded as illustrative rather than limiting, and that the following claims are intended to define the scope of this invention.

What is claimed is:

1. An improved punch pin comprising:

a stem, said stem having a longitudinal axis and a generally circular cross section adjacent one end, and a concavity formed in said one end defining a cutting edge surrounding said concavity, said cutting edge having a contour with two crests as points of initial entry into an article to be punched, and generally following the shape of a portion of the surface of an imaginary torus having a center and an axis of rotation perpendicular to a plane through said stem longitudinal axis, with the center of said torus being co-planar with said plane and spaced from said longitudinal axis, said torus having a diameter greater than a maximum diameter of said one stem end, said cutting edge being defined by the intersection of said imaginary torus surface and said one stem end and having a leading edge and a following edge, said leading edge engaging a workpiece before said following edge in use of said punch pin, with said crests being located on opposite sides of said cutting edge and about half-way between said leading and following edges.

2. The improved punch pin of claim 1 wherein the angle between said stem longitudinal axis and a radial line from said torus center intersecting at the midpoint of a line between said points of entry of said pin is about 6.7°.

3. A method for making an improved cutting edge for a punch pin having a generally cylindrical stem, a longitudinal axis and a circular cross section, with the cutting edge containing two points of entry on opposite sides of the stem, comprising:

cutting said stem through said base with a rotating cutting implement having the general surface shape of the outside of a torus with said stem longitudinal axis being slightly angled at about 6.7° relative to a radial line extending from the center of said torus and intersecting said longitudinal axis along a line extending between said points of entry, said torus having a radius of about 1.25 inches, a crown having a radius of about 0.2 inches and said pin cylindrical stem having a radius of about 0.14 inches, and forming said points of entry on opposite sides of said cutting edge and about half-way between said leading and following edges.

* * * * *